US011739900B1

(12) United States Patent
Chang

(10) Patent No.: US 11,739,900 B1
(45) Date of Patent: Aug. 29, 2023

(54) VEHICLE LAMP HAVING SWITCHING STRUCTURE FOR LOW-BEAM AND HIGH-BEAM HEADLIGHTS

(71) Applicant: SONAR AUTO PARTS CO., LTD., New Taipei (TW)

(72) Inventor: Chung-Yi Chang, Hsinchu County (TW)

(73) Assignee: SONAR AUTO PARTS CO., LTD., New Taipei (TW)

( * ) Notice: Subject to any disclaimer, the term of this patent is extended or adjusted under 35 U.S.C. 154(b) by 0 days.

(21) Appl. No.: 18/145,827

(22) Filed: Dec. 22, 2022

(51) Int. Cl.

| | |
|---|---|
| ***F21S 41/63*** | (2018.01) |
| ***F21S 41/683*** | (2018.01) |
| ***F21S 41/68*** | (2018.01) |
| *F21Y 115/10* | (2016.01) |

(52) U.S. Cl.
CPC ..... *F21S 41/635* (2018.01); *F21S 41/68* (2018.01); *F21S 41/683* (2018.01); *F21Y 2115/10* (2016.08)

(58) Field of Classification Search
CPC ..... F21S 41/635; F21S 41/68; F21S 41/683
See application file for complete search history.

(56) References Cited

U.S. PATENT DOCUMENTS

| | | | | |
|---|---|---|---|---|
| 11,047,545 | B1 * | 6/2021 | Chang | F21S 41/25 |
| 11,603,977 | B1 * | 3/2023 | Wu | F21S 41/32 |

* cited by examiner

*Primary Examiner* — Evan P Dzierzynski
*Assistant Examiner* — Nathaniel J Lee
(74) *Attorney, Agent, or Firm* — Li & Cai Intellectual Property Office

(57) ABSTRACT

A vehicle lamp having a switching structure for low-beam and high-beam headlights is provided. The vehicle lamp includes a heat dissipating device, an LED light source, an electromagnet, a reflector, a lens unit, a light-shaping plate, a driving rod, and an adjustment rod. The LED light source and the electromagnet are disposed on the heat dissipating device, and the light-shaping plate is rotatably disposed above the electromagnet. The driving rod is disposed between the electromagnet and the light-shaping plate. The electromagnet drives the driving rod to synchronously drive the light-shaping plate to be moved to a first position or a second position. The adjustment rod is disposed on the heat dissipating device, one end of the adjustment rod abuts against the light-shaping plate, and another end of the adjustment rod is exposed from the heat dissipating device.

10 Claims, 10 Drawing Sheets

VEHICLE LAMP HAVING SWITCHING STRUCTURE FOR LOW-BEAM AND HIGH-BEAM HEADLIGHTS

FIELD OF THE DISCLOSURE

The present disclosure relates to a vehicle lamp, and more particularly to a vehicle lamp having a switching structure for low-beam and high-beam headlights.

BACKGROUND OF THE DISCLOSURE

Vehicles such as automobiles or motorcycles generally have low-beam and high-beam headlights disposed thereon as vehicle lamps. The low-beam and high-beam headlight can be switched between low-beam and high-beam modes by using a switching structure. The switching structure includes a light-shaping plate that is disposed in front of a light source, and the light-shaping plate can be driven by an electromagnet to change a reflected light of the light source to achieve switching between the low-beam and high-beam modes. However, the light-shaping plate of the existing switching structure can be switched only to fixed positions that are incapable of being adjusted. Therefore, if the light-shaping plate is not switched to a correct position, an angle of the reflected light will be negatively affected, thus inevitably affecting an irradiation function of a low-beam.

SUMMARY OF THE DISCLOSURE

In response to the above-referenced technical inadequacies, the present disclosure provides a vehicle lamp having a switching structure for low-beam and high-beam headlights. The vehicle lamp can adjust a position of a light-shaping plate, so that the light-shaping plate can be fine-tuned to an optimal position for reflecting light, so as to provide an irradiation function for producing a low-beam.

In one aspect, the present disclosure provides a vehicle lamp having a switching structure for low-beam and high-beam headlights. The vehicle lamp includes a heat dissipating device, an LED light source, an electromagnet, a reflector, a lens unit, a light-shaping plate, a driving rod, and an adjustment rod. The LED light source is disposed on the heat dissipating device. The electromagnet is disposed on the heat dissipating device. The reflector is located above the LED light source and has a reflection surface. The lens unit is located in front of the reflector. Light emitted from the LED light source is able to be reflected by the reflection surface of the reflector and be irradiated outward through the lens unit. The light-shaping plate is rotatably disposed between the reflector and the lens unit, and is able to be moved between a first position and a second position. The light-shaping plate has a stressed portion. The driving rod is disposed between the electromagnet and the light-shaping plate. The electromagnet is capable of driving the driving rod to synchronously drive the light-shaping plate to be moved to the first position or the second position, so as to change a reflected light of the LED light source, such that the reflected light forms a low-beam or a high-beam. The adjustment rod is disposed on the heat dissipating device. One end of the adjustment rod abuts against the stressed portion of the light-shaping plate, and when the adjustment rod rotates, the adjustment rod is capable of pushing against the stressed portion, such that the light-shaping plate is synchronously driven through the stressed portion so that a position of the light-shaping plate is adjusted.

In certain embodiments, the driving rod has a pivot portion, an active end, and a passive end. The active end and the passive end are respectively connected to two ends of the pivot portion, the pivot portion is pivotally connected to a pivot shaft of the heat dissipating device, and the active end and the passive end are respectively connected to the electromagnet and the light-shaping plate.

In certain embodiments, the active end is capable of moving along a left-right direction and the passive end is capable of moving along a front-rear direction, so as to change directions of power transmission of the electromagnet and the light-shaping plate.

In certain embodiments, the light-shaping plate has a shielding portion and a linkage portion. The linkage portion is connected to the shielding portion, and the driving rod is connected to the linkage portion of the light-shaping plate. The shielding portion includes a bottom plate and a rear plate, and the rear plate is erected at an edge of the bottom plate. The bottom plate and the rear plate have an included angle therebetween that is greater than 90 degrees, so that the bottom plate is obliquely connected to the rear plate, and a height of the rear plate is decreased from two sides of the rear plate toward the middle of the rear plate.

In certain embodiments, the electromagnet is disposed at a front end of the heat dissipating device, and the electromagnet is horizontally disposed at the front end of the heat dissipating device.

Therefore, in the vehicle lamp having a switching structure for low-beam and high-beam headlights provided by the present disclosure, the vehicle lamp includes a heat dissipating device, an LED light source, an electromagnet, a reflector, a lens unit, a light-shaping plate, a driving rod, and an adjustment rod. Light emitted from the LED light source can be reflected by a reflection surface of the reflector and irradiated outward through the lens unit. The light-shaping plate is rotatably disposed between the reflector and the lens unit, and is able to be moved between a first position and a second position. The driving rod is disposed between the electromagnet and the light-shaping plate. The electromagnet can drive the driving rod to synchronously drive the light-shaping plate to be moved to the first position or the second position so as to change a reflected light of the LED light source, such that the reflected light forms a low-beam or a high-beam. The adjustment rod is disposed on the heat dissipating device. One end of the adjustment rod abuts against the stressed portion of the light-shaping plate, and when the adjustment rod rotates, the adjustment rod can push against the stressed portion, such that the stressed portion synchronously drives the light-shaping plate so that a position of the light-shaping plate is adjusted. Therefore, the light-shaping plate can be fine-tuned to an optimal position for reflecting light, so as to provide an irradiation function for producing a low-beam.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
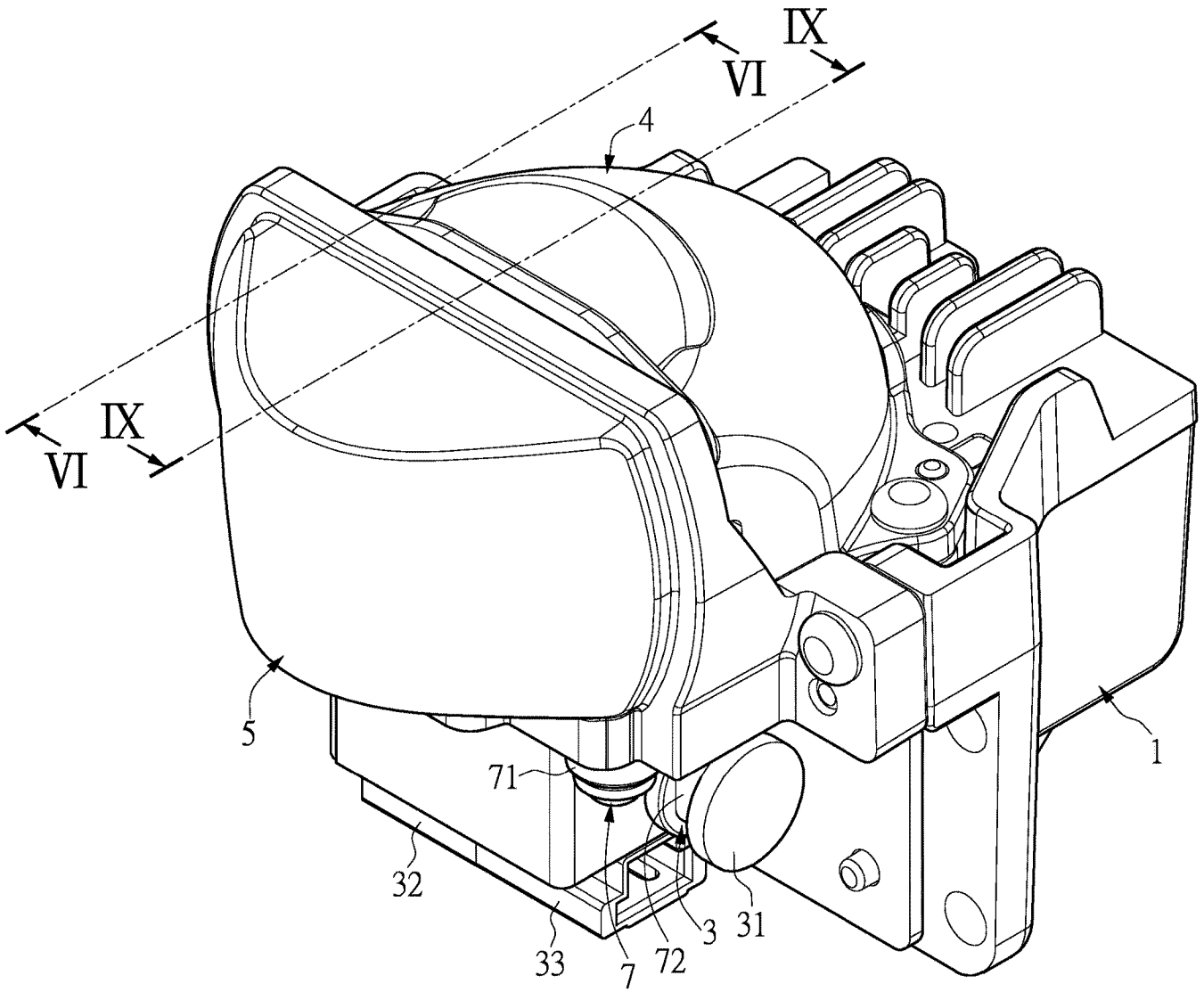
FIG. 1 is a schematic perspective view of a vehicle lamp having a switching structure for low-beam and high-beam headlights of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

EMBODIMENT

Figure 2:
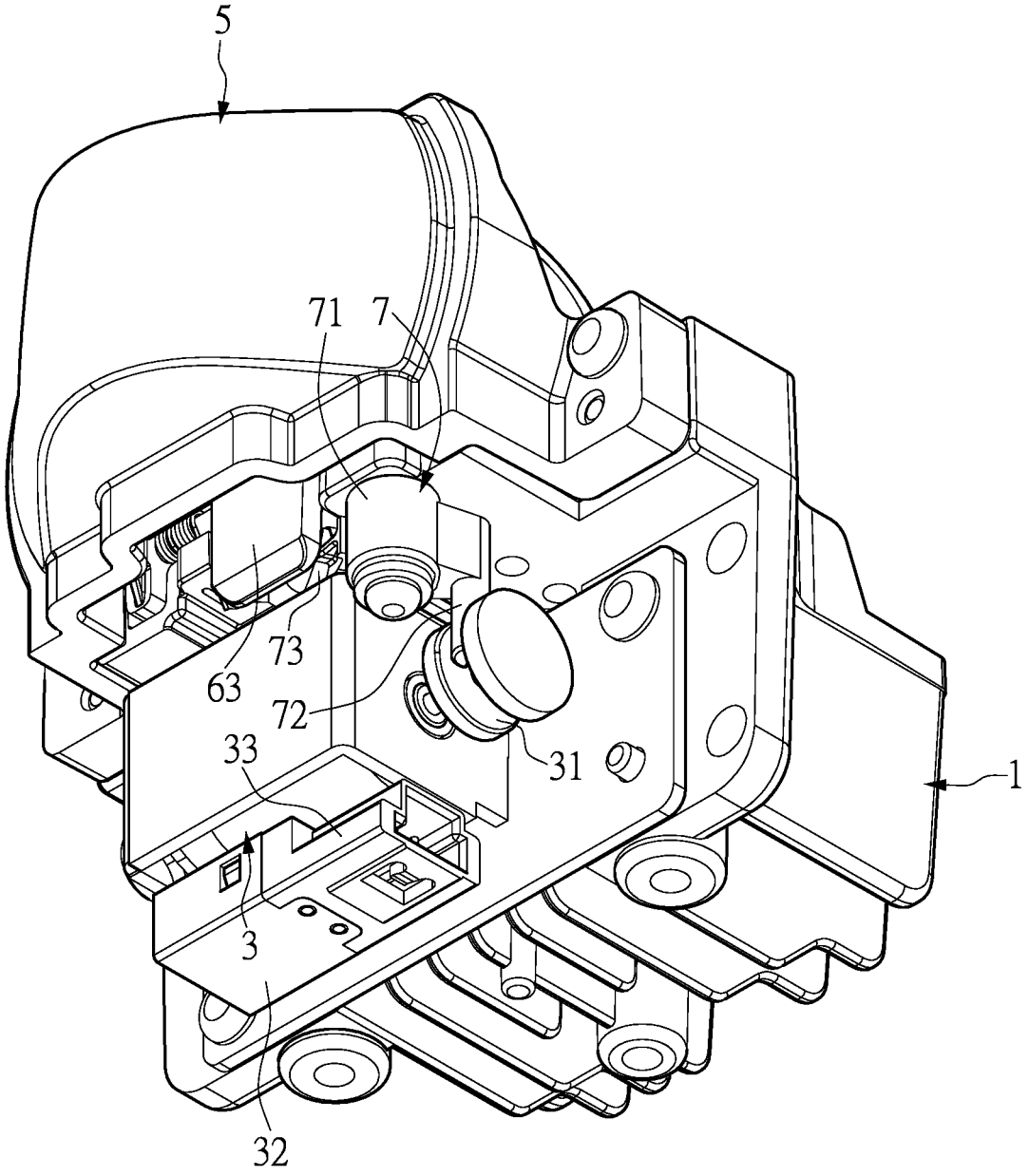
FIG. 2 is another schematic perspective view of the vehicle lamp of the present disclosure.
Figure 3:
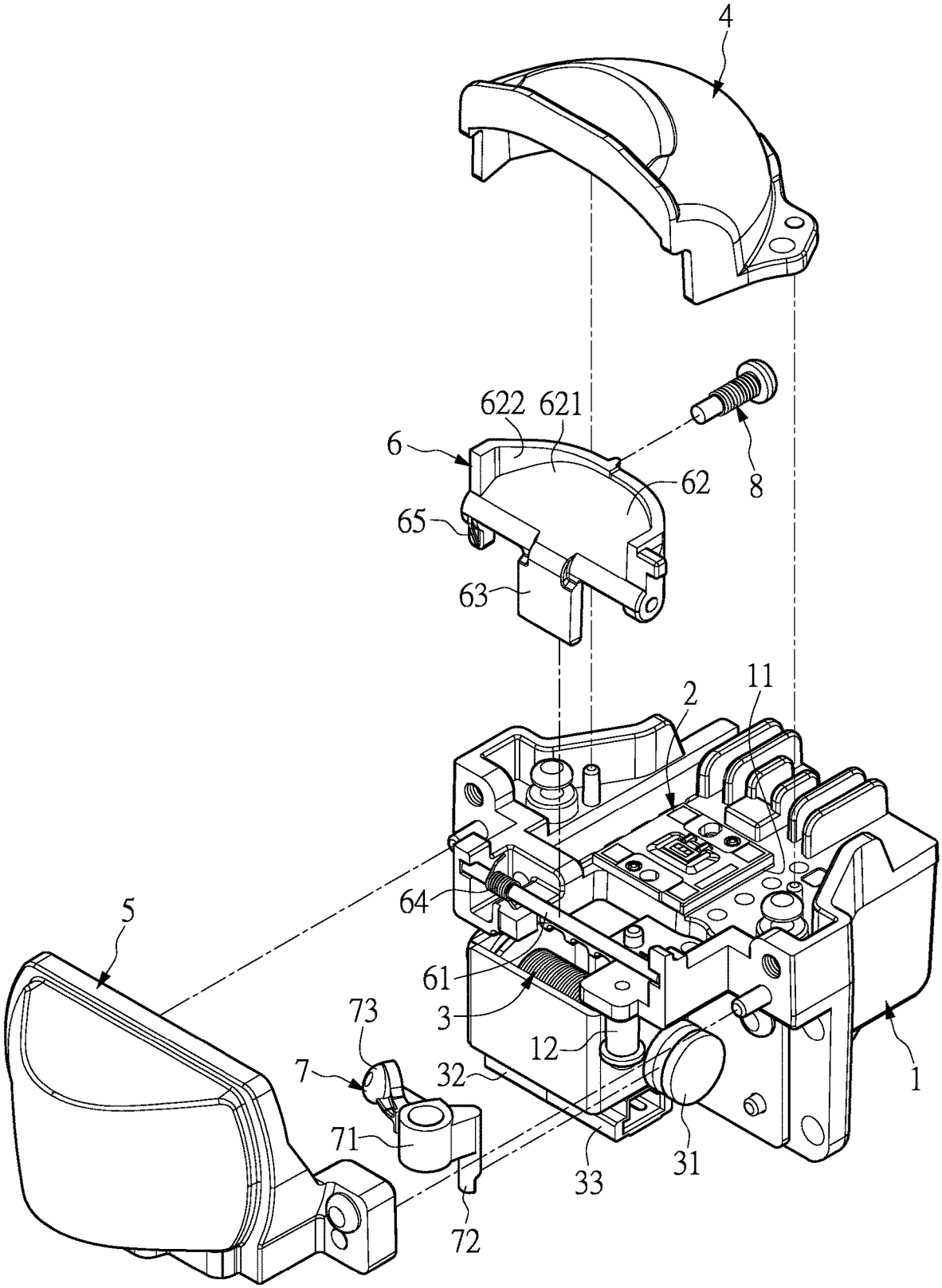
FIG. 3 is a schematic exploded perspective view of the vehicle lamp of the present disclosure.

Referring to FIG. 1 to FIG. 3, one embodiment of the present disclosure provides a vehicle lamp having a switching structure for low-beam and high-beam headlights. The vehicle lamp is suitable for being mounted on an automobile or motorcycle to switch between low-beam and high-beam. The vehicle lamp includes a heat dissipating device 1, an LED light source 2, an electromagnet 3, a reflector 4, a lens unit 5, a light-shaping plate 6, a driving rod 7, and an adjustment rod 8.

Figure 4:
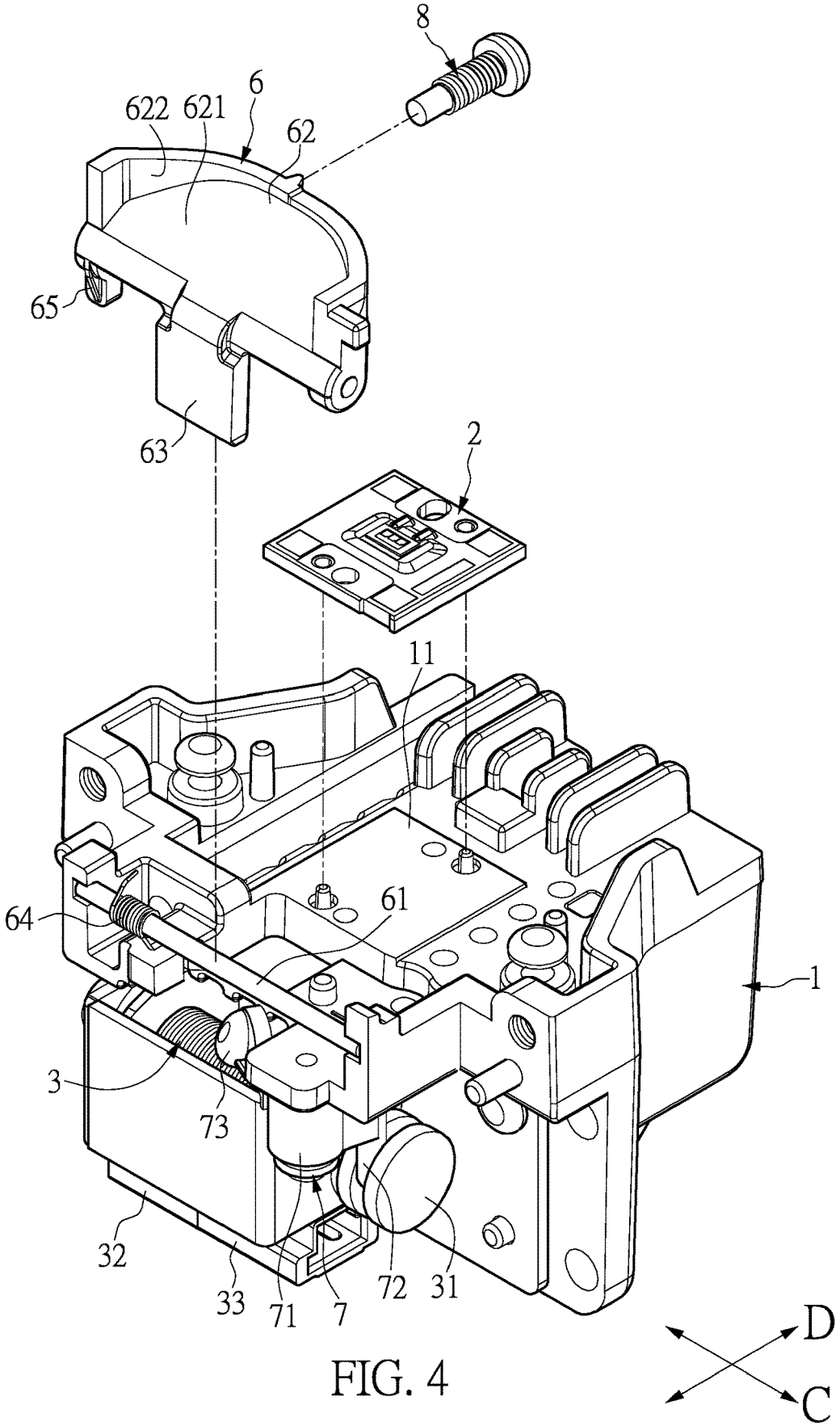
FIG. 4 is a schematic perspective view of an internal structure of the vehicle lamp of the present disclosure.

The heat dissipating device 1 is manufactured from a metal material (e.g., copper or aluminum) having good thermal conductivity, and a structure of the heat dissipating device 1 is not limited in the present disclosure. The LED light source 2 is disposed on the heat dissipating device 1. In this embodiment, the heat dissipating device 1 has a carrying surface 11 (as shown in FIG. 4), the LED light source 2 is disposed on the carrying surface 11, and the LED light source 2 can emit light upwardly. A heat generated from the LED light source 2 can be transmitted to the heat dissipating device 1, so that the heat dissipating device 1 can be used to facilitate heat dissipation.

The electromagnet 3 is disposed on the heat dissipating device 1. The electromagnet 3 can be disposed at a front end of the heat dissipating device 1, and the electromagnet 3 can include an action rod 31 for outputting power. A Zener diode 32 and a connector 33 can be disposed at a bottom portion of the electromagnet 3. The Zener diode 32 is electrically connected between the electromagnet 3 and the connector 33 and provides voltage stabilization. The connector 33 can be used to input an electrical power, and the electrical power is transmitted to the electromagnet 3 through the Zener diode 32, so that an operation of the electromagnet 3 can be controlled.

Figure 6:
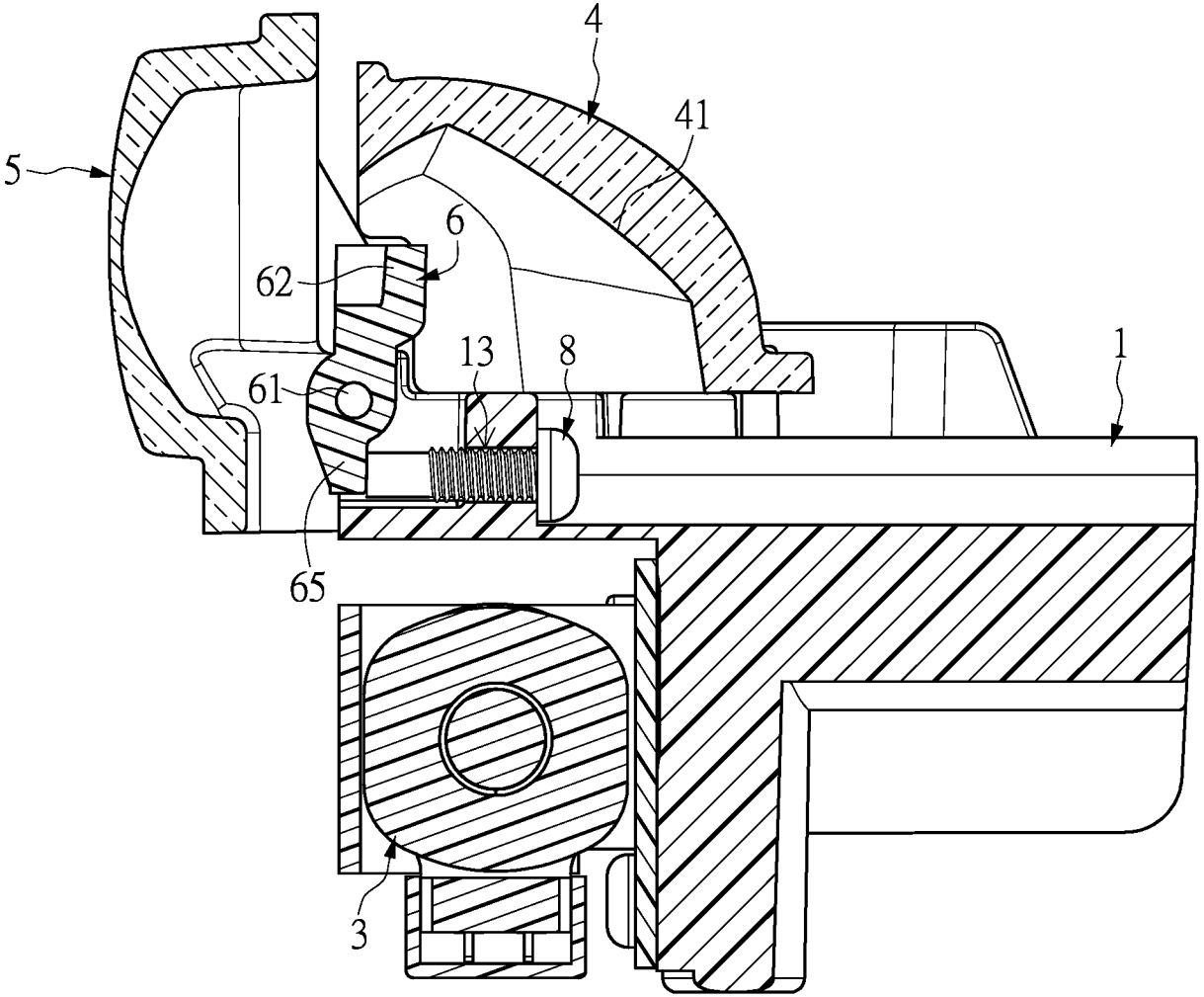
FIG. 6 is a cross-sectional view taken along line VI-VI of FIG. 1.

The reflector 4 is located above the LED light source 2 and has a reflection surface 41 (as shown in FIG. 6), and the reflection surface 41 is located at an inner side of the reflector 4. The lens unit 5 is located in front of the reflector 4, and the reflector 4 and the lens unit 5 can be disposed on the heat dissipating device 1. Light emitted from the LED light source 2 can be reflected by the reflection surface 41 of the reflector and be irradiated outward through the lens unit 5.

Figure 5:
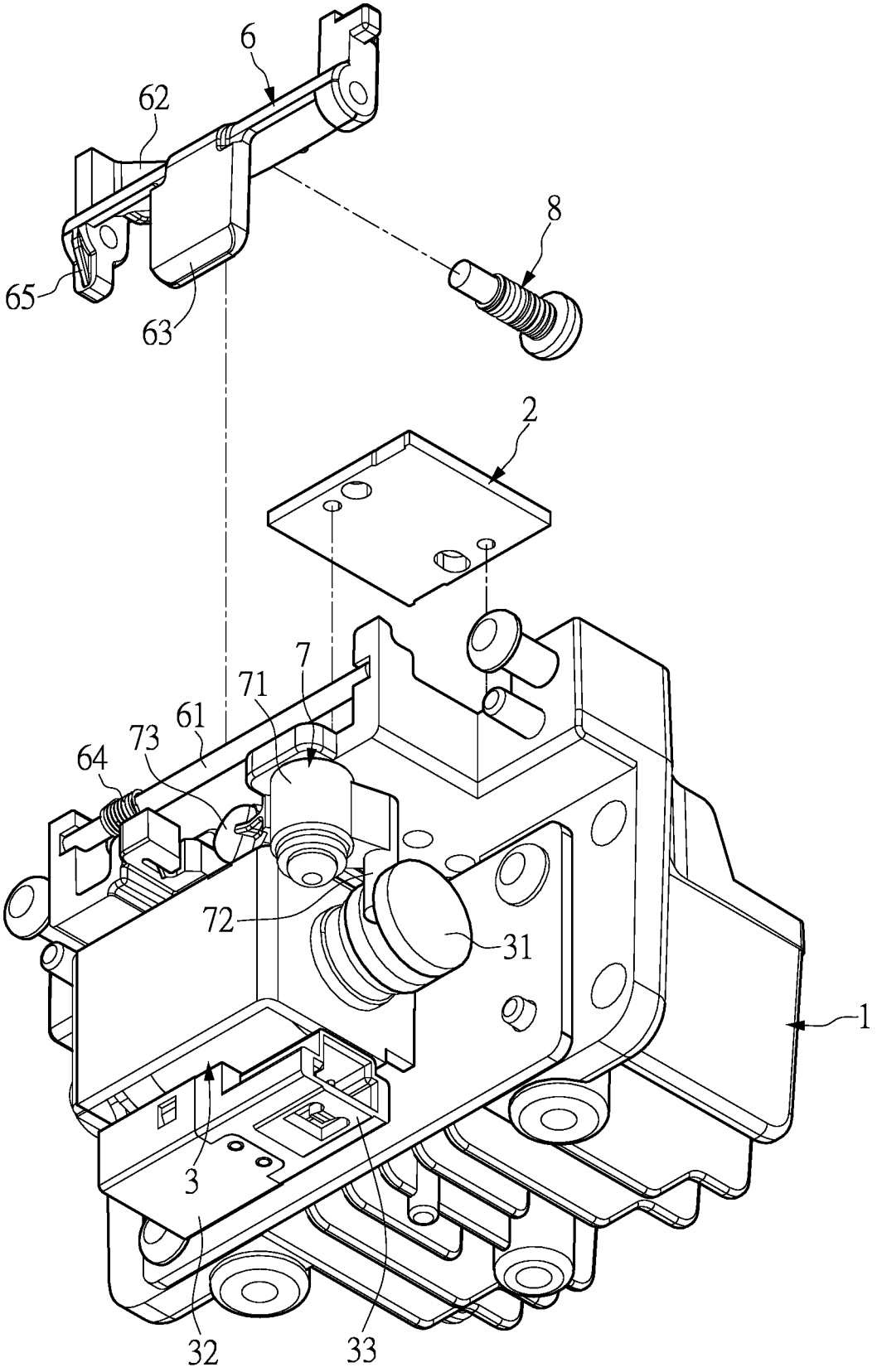
FIG. 5 is another schematic perspective view of an internal structure of the vehicle lamp of the present disclosure.
Figure 9:
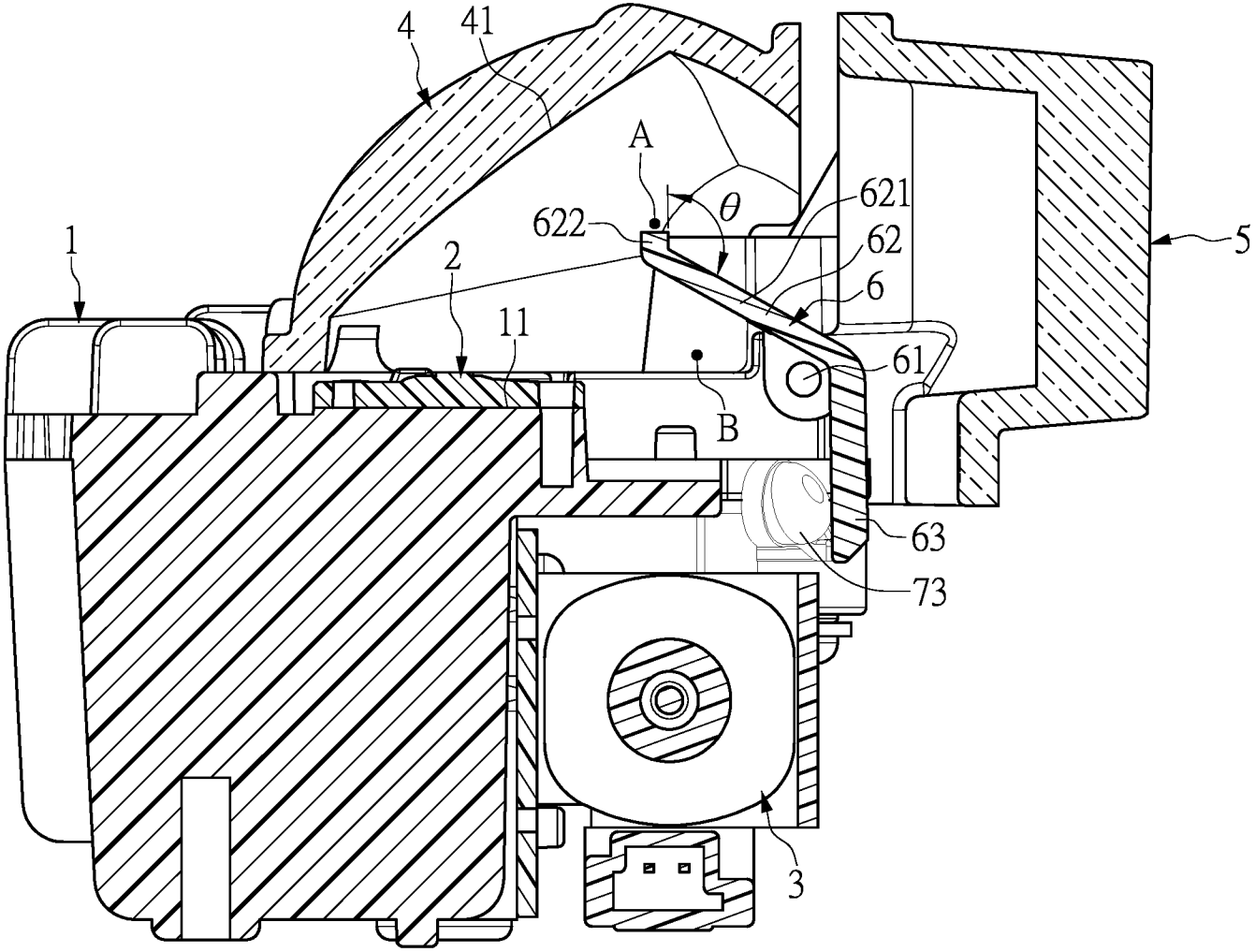
FIG. 9 is a cross-sectional view taken along line IX-IX of FIG. 1.
Figure 10:
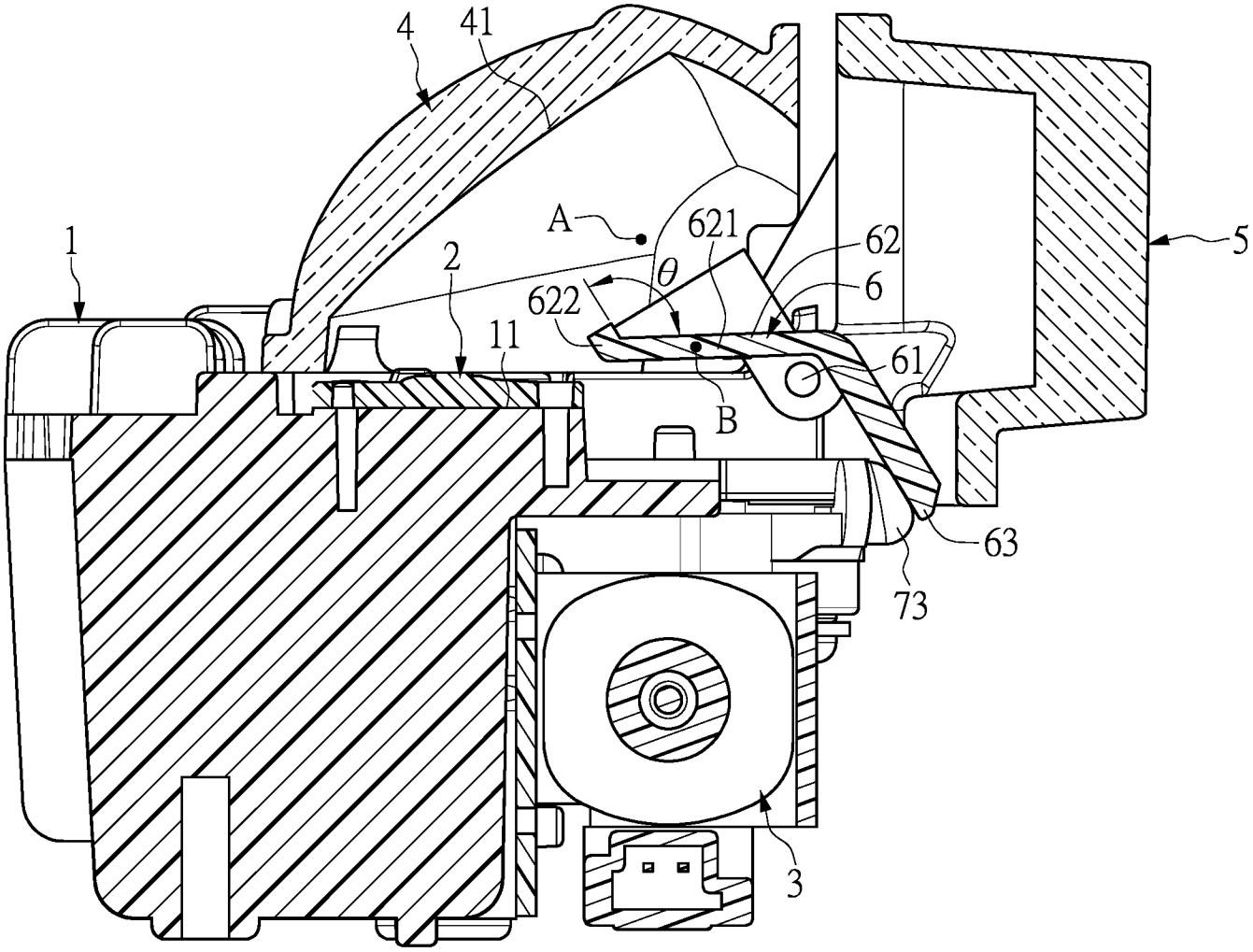
FIG. 10 is a cross-sectional view of the vehicle lamp of FIG. 9 in another configuration.

The light-shaping plate 6 is rotatably disposed between the reflector 4 and the lens unit 5, the light-shaping plate 6 is pivotally connected to the heat dissipating device 1 by a rotation shaft 61, and the light-shaping plate 6 can be located above the electromagnet 3. The light-shaping plate 6 can be moved between a first position A and a second position B (as shown in FIG. 9 and FIG. 10). The light-shaping plate 6 has a shielding portion 62 and a linkage portion 63, and the linkage portion 63 is connected to the shielding portion 62. An elastic element 64 (as shown in FIG. 4 and FIG. 5) can be sleeved on the rotation shaft 61, and two ends of the elastic element 64 respectively abut against the heat dissipating device 1 and the light-shaping plate 6, so as to provide an elastic force for allowing elastic recovery of the light-shaping plate 6 so that the light-shaping plate 6 is moved to the first position A. Preferably, the shielding portion 62 includes a bottom plate 621 and a rear plate 622, the rear plate 622 is a plate body that is arc-shaped, and the rear plate 622 is erected at an edge of the bottom plate 621. The bottom plate 621 and the rear plate 622 have an included angle θ therebetween (as shown in FIG. 9 and FIG. 10) that is greater than 90 degrees. The included angle θ is from 95 degrees to 150 degrees, e.g., the included angle θ can be 95 degrees, 100 degrees, 110 degrees, 120 degrees, 130 degrees, 140 degrees, or 150 degrees. The included angle θ is an obtuse angle, so that the bottom plate 621 is obliquely connected to the rear plate 622, and the bottom plate 621 and the rear plate 622 have a preferred angle therebetween. Furthermore, a height of the rear plate 622 is decreased from two sides of the rear plate 622 toward the middle of the rear plate 622, so that a better light shape can be presented.

The driving rod 7 is disposed between the electromagnet 3 and the light-shaping plate 6. The electromagnet 3 can drive the driving rod 7 to synchronously drive the light-shaping plate 6 to be moved to the first position A (as shown in FIG. 9) or the second position B (as shown in FIG. 10) so as to change a reflected light of the LED light source 2, such that the reflected light forms a low-beam or a high-beam. Specifically, the electromagnet 3 can drive the driving rod 7 to synchronously drive the light-shaping plate 6 to be raised to the first position A; at this time, the shielding portion 62 of the light-shaping plate 6 is raised and shields the light, so as to form a low-beam. Furthermore, the electromagnet 3 can drive the driving rod 7 to synchronously drive the light-shaping plate 6 to be lowered to the second position B; at this time, the shielding portion 62 of the light-shaping plate 6 is lowered and does not shield the light, so as to form a high-beam.

Preferably, the driving rod 7 has a pivot portion 71, an active end 72, and a passive end 73 (as shown in FIG. 3), the active end 72 and the passive end 73 are respectively connected to two ends of the pivot portion 71, and the pivot portion 71 is pivotally connected to a pivot shaft 12 of the heat dissipating device 1, so that the driving rod 7 can be rotatably disposed on the heat dissipating device 1. The active end 72 and the passive end 73 are respectively connected to the electromagnet 3 and the light-shaping plate 6. That is, the active end 72 can be connected to the action rod 31 of the electromagnet 3, and the passive end 73 can be connected to the linkage portion 63 of the light-shaping plate 6. In this embodiment, the active end 72 abuts against the action rod 31 of the electromagnet 3, and the passive end 73 abuts against the linkage portion 63 of the light-shaping plate 6, such that an assembly process is simple and easy, and a preferred power transmission structure can be formed.

When the electromagnet 3 is activated, the action rod 31 can drive the light-shaping plate 6 via the driving rod 7 so that the light-shaping plate 6 is located at the first position A or the second position B. Preferably, the active end 72 can move along a left-right direction C (as shown in FIG. 4), and the passive end 73 can move along a front-rear direction D. That is, the active end 72 can be pushed by the action rod 31 of the electromagnet 3 to move along the left-right direction C, and the passive end 73 can move along the front-rear direction D so as to push the linkage portion 63 of the light-shaping plate 6. Accordingly, the action rod 31 of the electromagnet 3 can drive the light-shaping plate 6 via the driving rod 7, thereby changing directions of power transmission of the electromagnet 3 and the light-shaping plate 6. Moreover, the arrangement of the electromagnet 3 and the light-shaping plate 6 can be more flexible, and the electromagnet 3 can be horizontally disposed at a front end of the heat dissipating device 1 so as to save an occupied space and decrease an overall height.

When the light-shaping plate 6 is located at the first position A, light emitted by the LED light source 2 is shielded after the light is reflected by the reflection surface 41 of the reflector 4, so that a light shape of the low-beam is produced. On the other hand, when the light-shaping plate 6 is located at the second position B, light emitted by the LED light source 2 is not shielded after the light is reflected by the reflection surface 41 of the reflector 4, so that a light shape of the high-beam is produced. Since the way that the light-shaping plate 6 is used to change a reflected light of a light source is known to those of ordinary skill in the art, details thereof will not be iterated herein.

Figure 7:
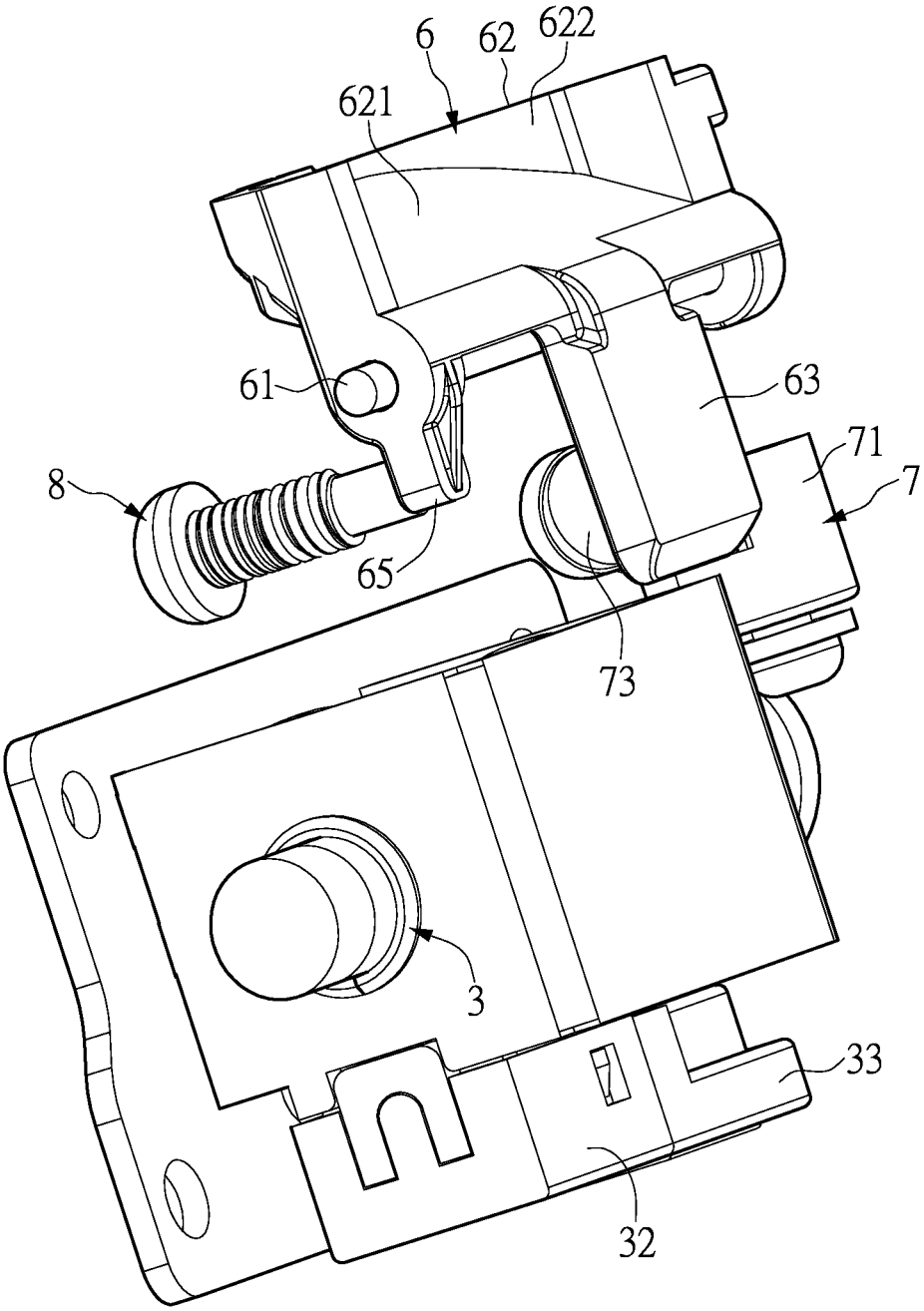
FIG. 7 is a schematic perspective view of a partial structure of the vehicle lamp of the present disclosure.
Figure 8:
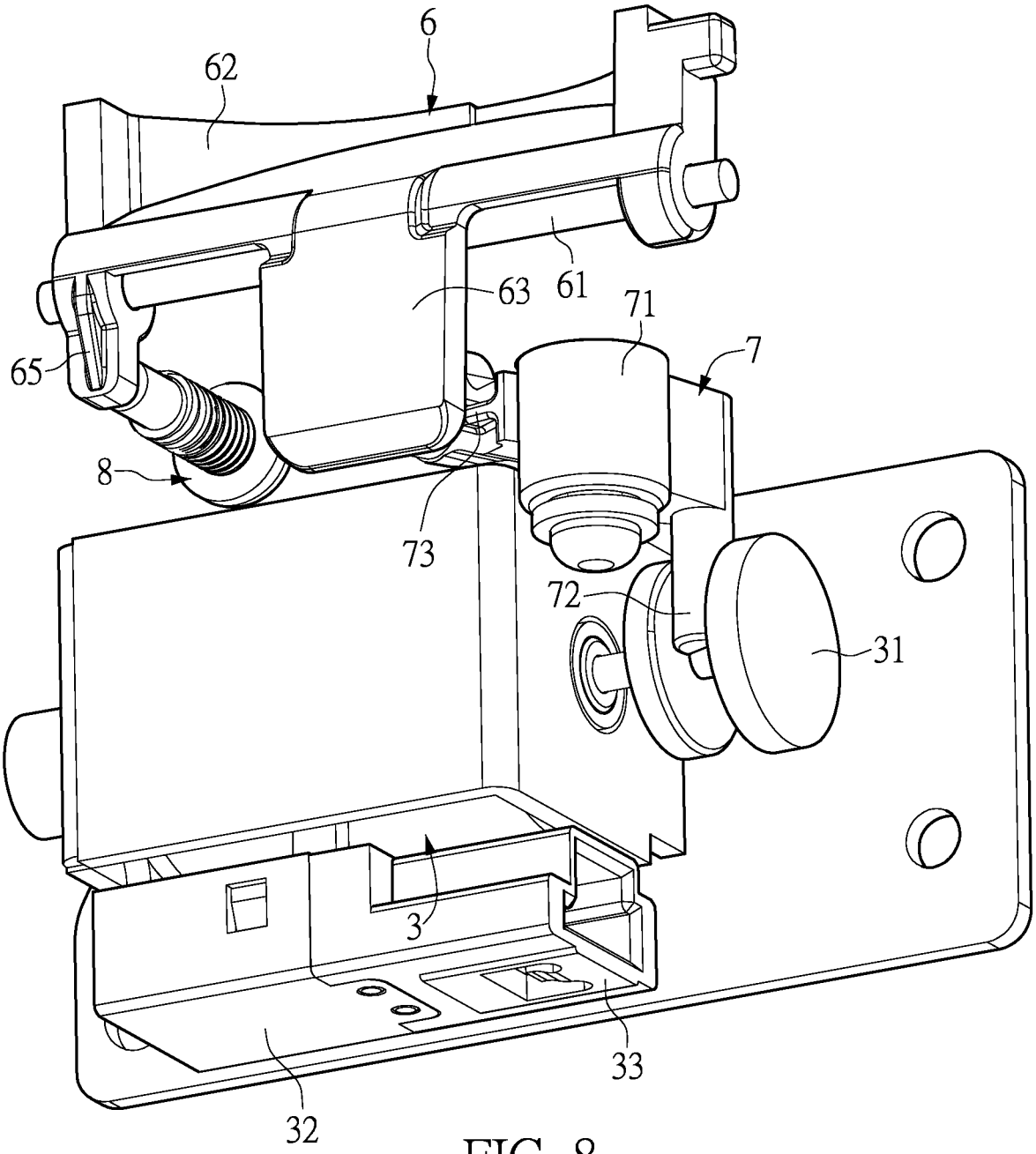
FIG. 8 is another schematic perspective view of the partial structure of the vehicle lamp of the present disclosure.

Reference is made to FIG. 6 to FIG. 8, in which the adjustment rod 8 is disposed on the heat dissipating device 1, and the adjustment rod 8 can penetrate through the heat dissipating device 1. One end of the adjustment rod 8 abuts against the light-shaping plate 6, and another end of the adjustment rod 8 is exposed from the heat dissipating device 1 to facilitate turning and adjusting of the adjustment rod 8. In this embodiment, the adjustment rod 8 can be a screw, and the adjustment rod 8 is threadedly connected to the heat dissipating device 1. The adjustment rod 8 can be threadedly connected to a threaded hole 13 of the heat dissipating device 1 (as shown in FIG. 6). Preferably, the adjustment rod 8 is near a top portion of one side of the heat dissipating device 1. The adjustment rod 8 can be horizontally disposed, but it is not limited thereto. An angle by which the adjustment rod 8 is disposed can also be modified according to practical requirements. The light-shaping plate 6 has a stressed portion 65, the stressed portion 65 can be disposed on one side of the shielding portion 62, and the one end of the adjustment rod 8 abuts against the stressed portion 65 of the light-shaping plate 6. When the adjustment rod 8 rotates, the one end of the adjustment rod 8 can push against the stressed portion 65, and the stressed portion 65 synchronously drives the light-shaping plate 6 to rotate, so that a position of the light-shaping plate 6 is adjusted. Therefore, the light-shaping plate 6 can be fine-tuned to an optimal position.

Beneficial Effects of the Embodiment

In conclusion, in the vehicle lamp having a switching structure for low-beam and high-beam headlights provided by the present disclosure, the vehicle lamp includes a heat dissipating device, an LED light source, an electromagnet, a reflector, a lens unit, a light-shaping plate, a driving rod, and an adjustment rod. Light emitted from the LED light source can be reflected by a reflection surface of the reflector and irradiated outward through the lens unit. The light-shaping plate is rotatably disposed between the reflector and the lens unit, and is able to be moved between a first position and a second position. The driving rod is disposed between the electromagnet and the light-shaping plate. The electromagnet can drive the driving rod to synchronously drive the light-shaping plate to be moved to the first position or the second position so as to change a reflected light of the LED light source, such that the reflected light forms a low-beam or a high-beam. The adjustment rod is disposed on the heat dissipating device. One end of the adjustment rod abuts against the stressed portion of the light-shaping plate, and when the adjustment rod rotates, the adjustment rod can push against the stressed portion, such that the stressed portion synchronously drives the light-shaping plate so that a position of the light-shaping plate is adjusted. Therefore, the light-shaping plate can be fine-tuned to an optimal position for reflecting light, so as to provide an irradiation function for producing a low-beam.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A vehicle lamp having a switching structure for low-beam and high-beam headlights, comprising:

a heat dissipating device;

an LED light source disposed on the heat dissipating device;

an electromagnet disposed on the heat dissipating device;

a reflector located above the LED light source and having a reflection surface;

a lens unit located in front of the reflector, wherein light emitted from the LED light source is able to be reflected by the reflection surface of the reflector and be irradiated outward through the lens unit;

a light-shaping plate being rotatably disposed between the reflector and the lens unit, and being able to be moved between a first position and a second position; wherein the light-shaping plate has a stressed portion;

a driving rod disposed between the electromagnet and the light-shaping plate; wherein the electromagnet is capable of driving the driving rod to synchronously drive the light-shaping plate to be moved to the first position or the second position, so as to change a reflected light of the LED light source such that the reflected light forms a low-beam or a high-beam; and an adjustment rod disposed on the heat dissipating device; wherein one end of the adjustment rod abuts against the stressed portion of the light-shaping plate, and when the adjustment rod rotates, the adjustment rod is capable of pushing the stressed portion, such that the light-shaping plate is synchronously driven through the stressed portion so that a position of the light-shaping plate is adjusted.

2. The vehicle lamp according to claim 1, wherein the driving rod has a pivot portion, an active end, and a passive end, the active end and the passive end are respectively connected to two ends of the pivot portion, the pivot portion is pivotally connected to a pivot shaft of the heat dissipating device, and the active end and the passive end are respectively connected to the electromagnet and the light-shaping plate.

3. The vehicle lamp according to claim 2, wherein the active end is capable of moving along a left-right direction and the passive end is capable of moving along a front-rear direction, so as to change directions of power transmission of the electromagnet and the light-shaping plate.

4. The vehicle lamp according to claim 2, wherein the electromagnet includes an action rod, and the light-shaping plate has a shielding portion and a linkage portion; wherein the linkage portion is connected to the shielding portion, and the stressed portion is disposed on one side of the shielding portion; wherein the active end is connected to the action rod of the electromagnet, and the passive end is connected to the linkage portion of the light-shaping plate, so that when the electromagnet is activated, the action rod is capable of driving the light-shaping plate via the driving rod.

5. The vehicle lamp according to claim 4, wherein the active end abuts against the action rod of the electromagnet, and the passive end abuts against the linkage portion of the light-shaping plate.

6. The vehicle lamp according to claim 1, wherein the light-shaping plate has a shielding portion and a linkage portion, the linkage portion is connected to the shielding portion, and the driving rod is connected to the linkage portion of the light-shaping plate; wherein the shielding portion includes a bottom plate and a rear plate, the rear plate is a plate body that is arc-shaped, and the rear plate is erected at an edge of the bottom plate; wherein the bottom plate and the rear plate have an included angle therebetween that is greater than 90 degrees, so that the bottom plate is obliquely connected to the rear plate, and a height of the rear plate is decreased from two sides of the rear plate toward the middle of the rear plate.

7. The vehicle lamp according to claim 1, wherein the electromagnet is disposed at a front end of the heat dissipating device, and the electromagnet is horizontally disposed at the front end of the heat dissipating device.

8. The vehicle lamp according to claim 1, wherein the light-shaping plate is pivotally connected to the heat dissipating device by a rotation shaft, and the light-shaping plate is located above the electromagnet; wherein an elastic element is disposed between the heat dissipating device and the light-shaping plate to provide an elastic force for allowing elastic recovery of the light-shaping plate, so that the light-shaping plate is moved to the first position.

9. The vehicle lamp according to claim 1, wherein the adjustment rod is a screw, and the adjustment rod is threadedly connected to the heat dissipating device.

10. The vehicle lamp according to claim 1, wherein another end of the adjustment rod is exposed from the heat dissipating device.

* * * * *